US011882923B2

(12) United States Patent
Theron

(10) Patent No.: US 11,882,923 B2
(45) Date of Patent: Jan. 30, 2024

(54) STRAP ASSEMBLY FOR A WEARABLE MOBILE DEVICE AND METHOD OF USING THE SAME

(71) Applicant: Hand Held Products, Inc., Charlotte, NC (US)

(72) Inventor: Quinton Eduard Theron, Charlotte, NC (US)

(73) Assignee: Hand Held Products, Inc., Charlotte, NC (US)

( * ) Notice: Subject to any disclaimer, the term of this patent is extended or adjusted under 35 U.S.C. 154(b) by 60 days.

(21) Appl. No.: 17/804,493

(22) Filed: May 27, 2022

(65) Prior Publication Data

US 2023/0404248 A1 Dec. 21, 2023

(51) Int. Cl.
*G06K 7/10* (2006.01)
*A45F 5/00* (2006.01)

(52) U.S. Cl.
CPC ..... *A45F 5/00* (2013.01); *A45F 2005/008* (2013.01); *A45F 2200/0516* (2013.01)

(58) Field of Classification Search
CPC ..... G06K 7/10891; G06K 2007/10534; A45F 2200/0516; H04B 2001/3861; H04B 1/385; Y10T 224/93; G06F 1/163; A44C 5/14
USPC ..... 224/218
See application file for complete search history.

(56) References Cited

U.S. PATENT DOCUMENTS 4,766,299 A * 8/1988 Tierney ..... G06K 7/10891 362/103
5,587,577 A * 12/1996 Schultz ..... B60R 11/0241 235/462.46
7,871,006 B2 * 1/2011 Morris ..... G06K 7/10881 235/472.01
9,010,595 B2 * 4/2015 Yu ..... A45F 5/00 224/218
10,817,689 B2 * 10/2020 Mazzone ..... G06K 7/1417
11,412,837 B2 * 8/2022 Choi ..... G06K 7/1413

OTHER PUBLICATIONS

"KDC180 Bluetooth Barcode Scanner," KOAMTAC, 2 pages, (2022).
Dan Baldwin, "New Hand-Mounted Scanner Solution is One More Reason to Love Wearable Scanners," Zebra, 7 pages, (Dec. 10, 2021).

* cited by examiner

*Primary Examiner* — Adam J Waggenspack
(74) *Attorney, Agent, or Firm* — Alston & Bird LLP

(57) ABSTRACT

Various embodiments are directed to a hand strap apparatus for securing a mobile device relative to user's hand and methods of using the same. In various embodiments, the hand strap apparatus comprises a backhand strap plate configured for positioning against a backhand portion the user's hand based on an engagement of a strap mechanism with the user's hand; a backhand mount component configured to receive a mobile device to secure the mobile device in a mounted position relative to the backhand strap plate; a finger mount component configured to receive a detachable ring mount attachment in an attached position relative to the hand strap apparatus; wherein the backhand mount component is in electronic communication with the finger mount component such that, when the ring mount attachment is in the attached position, operation of the mobile device is controlled by a trigger button of the ring mount attachment.

19 Claims, 10 Drawing Sheets

STRAP ASSEMBLY FOR A WEARABLE MOBILE DEVICE AND METHOD OF USING THE SAME

FIELD OF THE INVENTION

Various embodiments described herein relate generally to armband fastening assemblies configured to easily attach a mobile device to an object such as a user's hand.

BACKGROUND

Applicant has identified many technical challenges and difficulties associated with attaching a mobile device to a mobile device user's hand. Through applied effort, ingenuity, and innovation, Applicant has solved problems related to these wearable accessory hand straps by developing solutions embodied in the present disclosure, which are described in detail below.

BRIEF SUMMARY

Various embodiments are directed to strap assemblies for wearable mobile devices and methods of using the same. In various embodiments, a strap assembly for wearable mobile devices may comprise a hand strap apparatus for securing a mobile device relative to a hand of a user, the hand strap comprising: a backhand strap plate configured for positioning against a backhand portion of the hand of the user based at least in part on an engagement of a strap mechanism with the hand of the user; a backhand mount component positioned on a top surface of the backhand strap plate, the backhand mount component being configured to receive a mobile device so as to secure the mobile device in a mounted position relative to the backhand strap plate; a finger mount component configured to receive a detachable ring mount attachment so as to secure the ring mount attachment in an attached position relative to the hand strap apparatus; wherein the backhand mount component is in electronic communication with the finger mount component such that, upon the ring mount attachment being provided in the attached position, an operation of the mobile device secured in the mounted position is at least partially controlled by a trigger button defined by the ring mount attachment.

In various embodiments, the backhand strap plate may include finger extension plate portion defined by a material extension extending from a proximal finger extension plate portion end to a distal finger extension plate portion end, the proximal finger extension plate portion end being defined at a first portion of the backhand strap plate configured for positioning against the backhand portion of the hand and the distal finger extension plate portion end being defined at a second portion of the backhand strap plate configured for positioning against a finger portion of the hand. In certain embodiments, the finger mount component may be positioned at least substantially adjacent the distal finger extension plate portion end. In various embodiments, the backhand mount component may define a first mobile device interface configured to engage a mounting interface defined by the mobile device so as to secure the mobile device in the mounted position relative to the backhand strap plate, and wherein the first mobile device interface defined by the backhand mount component is defined by a first configuration that is at least substantially similar to a second mobile device interface defined by the ring mount attachment. In certain embodiments, the finger mount component is configured to receive the detachable ring mount attachment at a ring mount attachment interface defined by the finger mount component, wherein the ring mount attachment interface is configured to engage the second mobile device interface defined by the ring mount attachment.

In various embodiments, the finger mount component may define a ring mount attachment interface configured to engage a mobile device interface defined by the ring mount attachment so as to secure the ring mount attachment in the attached position, and wherein the ring mount attachment interface is defined by a first configuration that is at least substantially similar to a mounting interface defined by the mobile device. In certain embodiments, the backhand mount component may be configured to secure the mobile device in the mounted position based at least in part on an engagement of a mobile device interface defined by the backhand mount component with the mounting interface. In various embodiments, the detachable ring mount attachment may be configured to be received by the finger mount component of the hand strap apparatus is configured such that, upon being removed from the attached position, the ring mount attachment is configured to independently receive the mobile device at a mobile device interface to facilitate an independent operation of the mobile device that is at least partially controlled by the trigger button.

In various embodiments, the attached position may be defined by the ring mount attachment received by the finger mount component being engaged with a ring mount attachment interface defined by the finger mount component, the ring mount attachment interface comprising one or more electronic connection elements configured to engage the ring mount attachment so as to establish an electronic connection between the trigger button of the ring mount attachment and the finger mount component. In certain embodiments, the one or more electronic connection elements may be configured to engage a second one or more electronic connection elements provided at a mobile device interface defined by the ring mount attachment, wherein the second one or more electronic connection elements are further configured for engagement with a third one or more electronic connection elements provided at a mounting interface defined by the mobile device such that the ring mount attachment provided in a detached configuration relative to the hand strap apparatus is configured for securing the mobile device relative to the ring mount attachment in a second mounted position defined at the mobile device interface. In certain embodiments, the ring mount attachment interface of the finger mount component is defined on a bottom side of the finger mount component such that the ring mount attachment being secured relative thereto in the attached position comprises the ring mount attachment being disposed at least substantially below the finger mount component.

In various embodiments, the hand strap apparatus may be configured such that, upon the ring mount attachment being secured relative thereto in the attached position, a ring strap of the ring mount attachment is configured for engagement with an index finger of the hand of the user. In various embodiments, the hand strap apparatus may further comprise a first strap mechanism connector and a second strap mechanism connector secured relative to the top surface of the backhand strap plate, the strap mechanism being configured to engage both the first strap mechanism connector and the second strap mechanism connector so as to define an at least partially adjustable configuration. In certain embodiments, the first strap mechanism connector may be disposed at least substantially adjacent a first lateral side of the backhand strap plate, wherein the second strap mechanism connector is disposed at least substantially adjacent a second lateral side of the backhand strap plate, the second lateral side embodying an opposite lateral side of the backhand strap plate relative to the first lateral side, and wherein the strap mechanism defines an adjustable length configured to extend between the first and second strap mechanism connectors by passing underneath a wrist portion of the hand of the user. In certain embodiments, the first strap mechanism connector may comprise a rivet component configured for coupling to a first strap end of the strap mechanism so as to define a pivotable engagement between the first strap end and the backhand strap plate, wherein the pivotable engagement defines a range of relative rotational motion between the backhand strap plate and the first strap end of the strap mechanism detachably fastened to the rivet component. In certain embodiments, the second strap mechanism connector may comprise a looped fastener defining an opening configured for receiving at least a second strap end of the strap mechanism therethrough to facilitate an adjustable configuration of the strap mechanism.

In various embodiments, the hand strap apparatus may further comprise internal circuitry extending from a first circuitry end electronically connected to the backhand mount component to a second circuitry end electronically connected to the finger mount component to facilitate the electronic communication between the backhand mount component and the finger mount component. In certain embodiments, the internal circuitry may be configured to transmit one or more control signals received by the hand strap apparatus to the mobile device provided in the mounted position, the one or more control signals being generated by a user engagement with the trigger button of the ring mount attachment. In certain embodiments, the internal circuitry may be provided within an interior portion of the backhand strap plate, the interior portion being defined between the top surface and a bottom surface thereof. In various embodiments, the mounted position is defined by the mobile device received by the backhand mount component being engaged with a mobile device interface defined by the backhand mount component, the mobile device interface comprising one or more electronic connection elements configured to engage the mobile device so as to establish an electronic connection between the mobile device and the hand strap apparatus.

BRIEF DESCRIPTION OF THE DRAWINGS

Reference will now be made to the accompanying drawings, which are not necessarily drawn to scale, and wherein.

DETAILED DESCRIPTION

Figure 1:
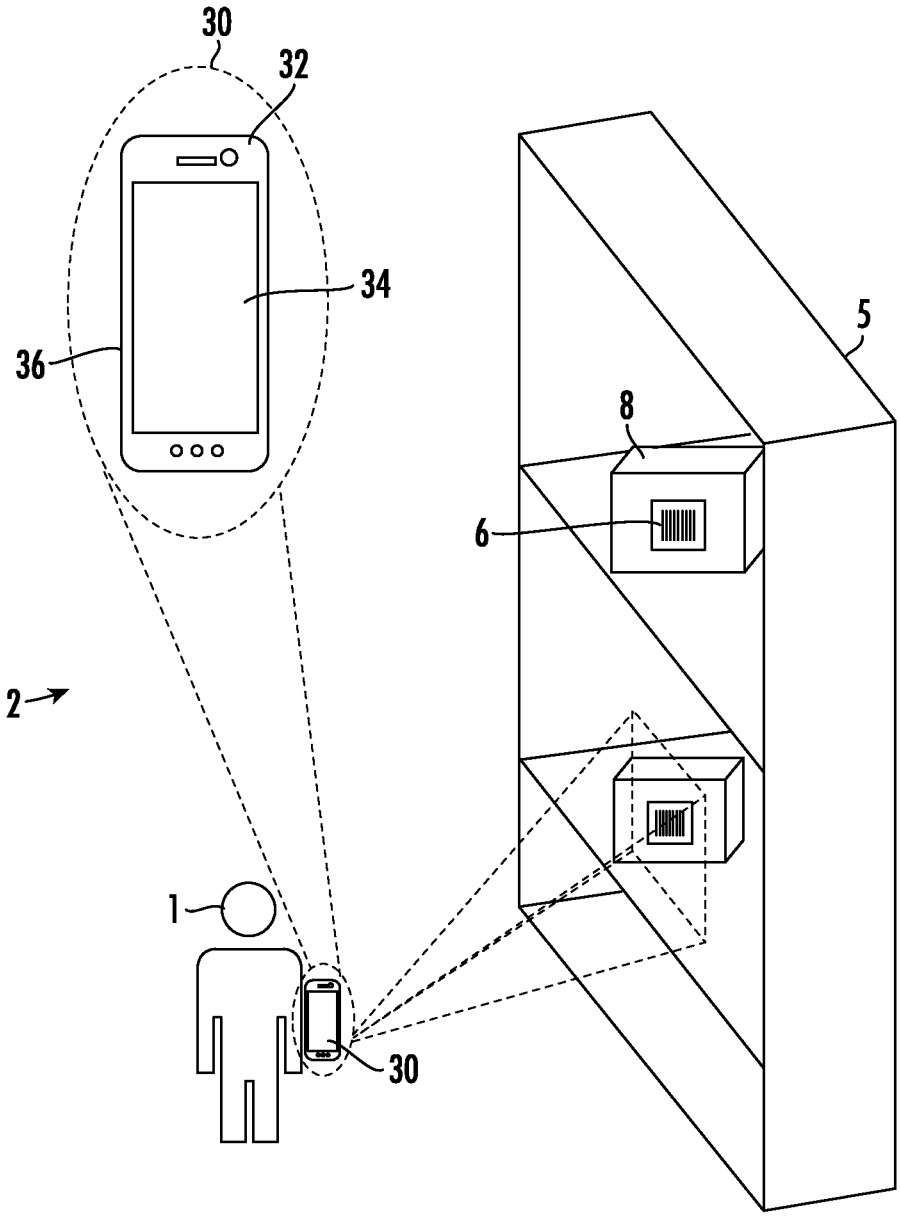
FIG. 1 illustrates an exemplary environment where a device may be used, according to one or more embodiments described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

Various example embodiments address technical problems associated with attaching and operably holding a mobile device to an object, such as a user's hand. As understood by those of skill in the field to which the present disclosure pertains, there are numerous scenarios in which it is beneficial to attach a mobile device to a user's hand. Attaching a mobile device to a user's arm, for example, allows the user the benefit of continued use of their hands while utilizing a mobile device while minimizing the risk of damage or loss of the mobile device. The positioning of the mobile device that is created by the hand strap apparatuses disclosed herein may also allow improved, intuitive functioning of the mobile device, such as hands-free scanning of decodable indicia. Various devices used to attach a mobile device to a user's arm, hand, and/or finger may be defined by bulky fastening hardware and an operable configuration that is ergonomically impractical or inefficient in many practical circumstances. Further, various devices and/or assemblies used to facilitate the wearing of a mobile device by a user may require large-scale hardware reconfigurations to switch between wearable mounting configurations, such as, for example, to accommodate user preferences and/or occupational requirements associated with a particular environment and/or a particular task. For example, such a change between devices may include a switch from a first wearable apparatus to a second wearable device having an entirely different control mechanism or means of controlling the mobile device attached thereto. Further, many devices become loose or easily detach during use. One skilled in the field to which the present disclosure pertains will appreciate further problems that may be resolved by various embodiments of the present disclosure.

The various embodiments herein, including but not limited to a hand strap apparatus for securing a mobile device relative to a hand of a user. As described herein, an exemplary hand strap apparatus may include a backhand strap plate configured for positioning against a backhand portion of the hand of the user, a backhand mount component configured to receive a mobile device so as to secure the mobile device in a mounted position relative to a top surface of the backhand strap plate; and a finger mount component configured to receive a detachable ring mount attachment so as to secure the ring mount attachment in an attached position relative to the hand strap apparatus; wherein the backhand device mount is in electronic communication with the finger mount component such that, upon the ring mount attachment being provided in the attached position, an operation of the mobile device secured in the mounted position is at least partially controlled by a trigger button defined by the ring mount attachment. In various embodiments, the hand strap apparatus may be configured to receive the detachable ring mount attachment such that the ring mount attachment is electronically connected with the finger mount component of the hand strap apparatus and one or more control signals generated based upon a user engagement with the trigger button of the ring mount attachment may be transmitted to the mobile device mounted to the hand strap apparatus to operate the mobile device.

As described herein, the exemplary hand strap apparatus is configured to operatively engage a mobile device interface of an independently operable ring mount attachment such that the same trigger button may be used to control the mobile device when the mobile device is mounted to the hand strap apparatus as may be used when the mobile device is independently mounted to the ring mount attachment. For example, the exemplary mobile device may be operably and independently secured to either the ring mount attachment (e.g., at a mobile device interface) or the hand strap apparatus (e.g., at a mobile device interface defined by a backhand mount component) in order to interchangeably reconfigure the mobile device between different wearable mounting configurations to accommodate user preferences and/or occupational requirements associated with a particular environment and/or a particular task. The hand strap apparatus described herein may be configured such that the different wearable mounting configurations—defined by the exemplary hand strap apparatus and the ring mount attachment—in which the mobile device may be independently operable, may each utilize the same trigger button defined on the detachable ring mount attachment to initiate activation of the mobile device. Such an exemplary configuration defines a hand strap apparatus and a wearable strap assembly that each embody modular configurations that enables a decrease in maintenance costs and operational expenses, and, further, increases the comfort experience by the user and the ease of cleaning the apparatus and/or the various components of the assembly.

Further, the present invention includes a hand strap assembly comprising a backhand strap plate configured to maximize ergonomic capacity of hand strap apparatus, such as, for example, by engaging a strap mechanism at a rotatable strap connector provided on the backhand strap plate to facilitate a range of relative rotational motion between the backhand strap plate and the strap mechanism, and further, defining a minimized surface area at which the backhand strap plate is engaged with dynamic features of a user's hand. As described herein, the present invention is configured to increase user dexterity and comfort during operation, and further minimizing the wear and tear during use of the hand strap apparatus.

FIG. 1 illustrates an exemplary environment 2 where a mobile device 30 may be used, according to one or more embodiments described herein. The exemplary environment 2 may include the mobile device 30, a user 1, a rack 5 and one or more objects 8 placed on the rack 5.

The mobile device 30 may include one or more components, circuitry, software modules, and/or the like that may enable the mobile device 30 to perform a predetermined operation in the exemplary environment 1. For example, the user 1 may utilize the mobile device 30 to scan the one or more objects 8 to obtain information pertaining to the one or more objects 8. In an example embodiment, the mobile device 30 may include an image capturing device 32 that may enable the mobile device 30 to capture an image of a barcode 6 on the one or more objects 8 and accordingly, obtain the information pertaining to the one or more objects 8 by decoding the barcode 6. Further, the mobile device 30 may include a communication module (not shown) that may enable the mobile device 30 to transmit the information pertaining to the one or more objects 8 to a remote computer. Furthermore, the mobile device 30 may include a display screen 34 that may display a user interface (UI) to the user 1. The user 1 may control the operation of the mobile device 30 based on inputs provided through the UI displayed on the display screen 34. Further, the display screen 34 may be configured to display the information pertaining to the one or more objects 8.

In some examples, the scope of the disclosure is not limited to the mobile device 30 comprising the image capturing device 32, the communication module, and the display screen 34. In an example embodiment, the mobile device 30 may include other electronic and mechanical components that enable the mobile device 30 to perform other operations, without departing from the scope of the disclosure. In an example embodiment, the mobile device 30 has a housing 36 that may be configured to partially or fully enclose the mobile device 30. For example, the housing 36 may be configured to partially or fully enclose the communication module, the display screen 34, and the image capturing device 32. In various embodiments, the housing 36 of an exemplary mobile device 30 may comprise one or more mounting features and/or electronic connection elements configured to facilitate attachment of the mobile device 30 to a wearable hand strap apparatus (not shown) being worn by a user 1.

Figure 2:
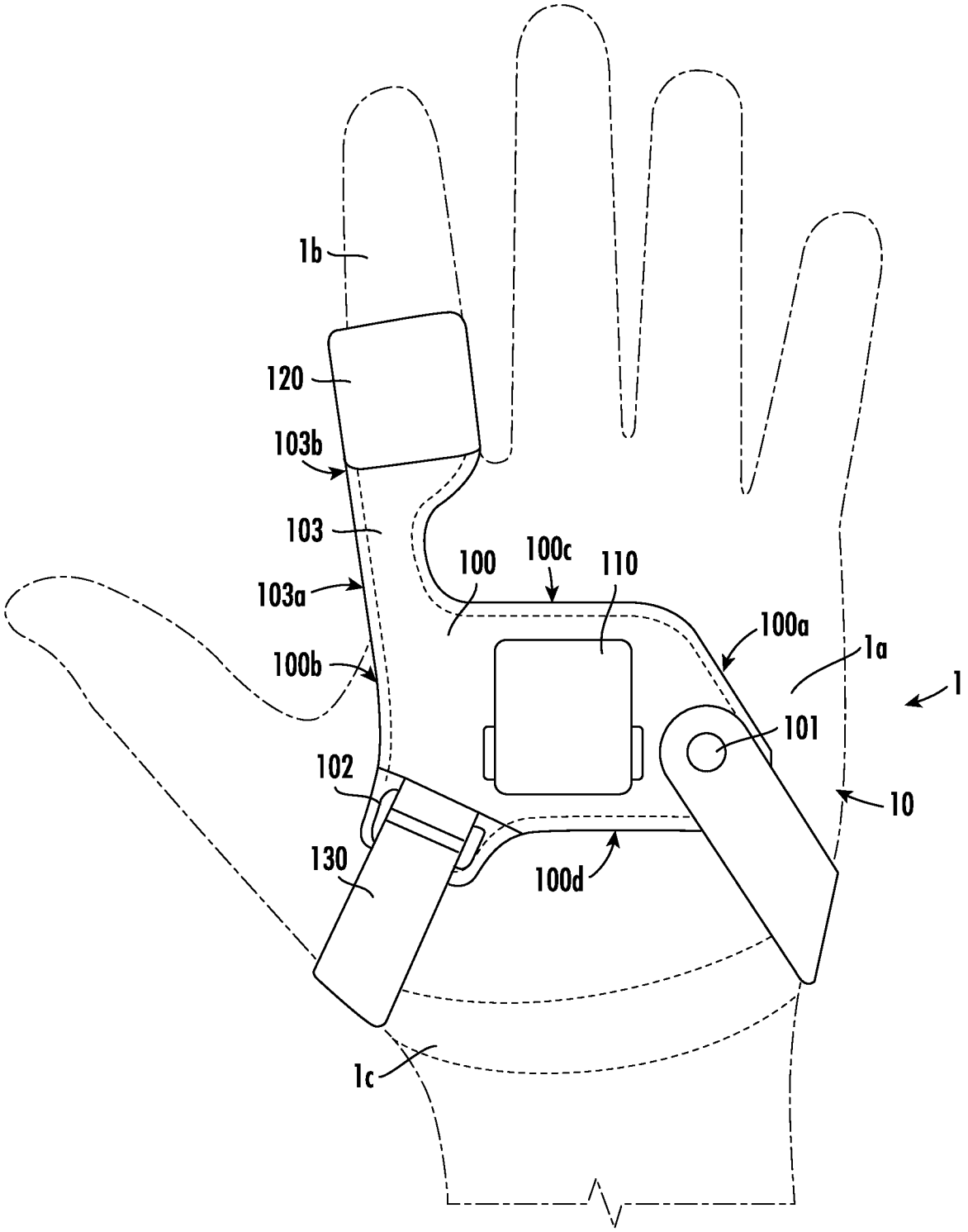
FIG. 2 illustrates a top view of an exemplary hand strap apparatus being worn by a user in accordance with one or more example embodiments described herein.

FIG. 2 illustrates a top view of an exemplary hand strap apparatus being worn by a user in accordance with one or more example embodiments described herein. In particular, FIG. 2 illustrates an exemplary hand strap apparatus 10 configured for attaching a mobile device (e.g., mobile device 30 shown in FIG. 1) to an object, such as, for example, the hand 1 of a user, as shown, in order to facilitate use of the mobile device without occupying one or both of the user's hands. It will be appreciated that the illustrated hand strap apparatus 10 and various depicted embodiments herein are provided as example embodiments and should not be construed to narrow the scope or spirit of the disclosure in any way. In various embodiments, an exemplary hand strap apparatus 10 may comprise a backhand strap plate 100, a backhand mount component 110, a finger mount component 120, and/or a strap mechanism 130. As illustrated, an exemplary hand strap apparatus 10 may comprise a backhand strap plate 100 comprising a material portion of the hand strap apparatus 10 that is configured to be worn against a backhand portion 1*a* of the hand 1 of a user based at least in part on an engagement of an adjustable strap 130 with the hand 1 of the user. For example, upon the hand strap apparatus 10 being donned by a user upon the hand 1, as illustrated in FIG. 2, a bottom surface of the backhand strap plate 100 may be positioned so as to extend along at least a portion of the backhand portion 1*a* of the user's hand 1 and a top surface of the backhand strap plate 100 may be configured to receive a mobile device at a backhand mount component 110 disposed thereon so as to facilitate the arrangement of the mobile device in a mounted position relative to the backhand portion 1*a* of the hand 1. In various embodiments, as described in further detail herein, a backhand mount component 110 disposed along a top surface of the backhand strap plate 100 may be configured to receive a mobile device thereon such that the mobile device is detachably secured in a mounted position atop the backhand strap plate 100. As described herein, an exemplary hand strap apparatus 10 may be configured such that a mobile device provided in a mounted position at the backhand mount component 110 may be at least partially secured relative to the hand 1 of a user (e.g., the backhand portion 1*a*).

As illustrated, in various embodiments, an exemplary backhand strap plate 100 may define a first lateral side 100*a*, a second lateral side 100*b* defined opposite the first lateral side 100*a*, a front side 100*c*, and a rear side 100*d*. For example, in an exemplary circumstance wherein the hand strap apparatus 10 is being worn on the hand 1 of a user such that the backhand strap plate 100 is arranged along the backhand portion 1*a* of a user's hand 1, the first lateral side 100*a* may be defined by the lateral side positioned at least substantially adjacent an outer side of the user's hand 1 (e.g., the side at least substantially adjacent the user's pinky), while the opposing second lateral side 100*b* may be defined by the opposite lateral side positioned at least substantially the user's thumb and/or index finger. Further, in such an exemplary circumstance, the top side 100*c* of the backhand strap portion 100 may be defined by the side positioned at least substantially adjacent the finger portion 1*b* of the user's hand 1, while the opposing bottom side 100*d* of the backhand strap portion 100 may be defined by the side positioned opposite the top side 100*c* at least substantially adjacent a base of the user's hand 1, such as, for example, adjacent a wrist portion 1*c* of the hand 1.

Further, as described herein, a backhand strap plate 100 may comprise a finger extension plate portion 103 comprising a material extension extending from a proximal finger extension plate portion end 103*a* defined at a portion of the backhand strap plate 100 configured to be worn on a backhand portion 1*a* of the user's hand 1, to a distal finger extension plate portion end 103*b* configured to be worn at a finger portion 1*b* of the user's hand 1*b*. For example, in various embodiments, the finger extension plate portion 103 may extend from a top side 100*c* of the backhand strap plate 100 such that the proximal finger extension plate portion end 103*a* is defined at a top side 100*c* of the backhand strap plate 100*c*. As described herein, the distal finger extension plate portion end 103*b* of the finger extension plate portion 103 may be attached to and/or at least partially defined by a finger mount component 120 configured to receive a ring mount attachment (not shown) at a finger portion 1*b* of the user's hand 1 such that a mobile device provided in a mounted position on the backhand mount component 110 may be operated using a trigger button defined by the ring mount attachment. For example, the finger extension plate portion 103 of an exemplary backhand strap plate 100 may be defined by a length extending between the proximal finger extension plate portion end 103*a* and the distal finger extension plate portion end 103*a*. For example, in various embodiments, an exemplary finger extension plate portion 103 may be defined by a length of at least approximately between 15 mm and mm (e.g., between 26 mm and 40 mm). As described herein, the hand strap apparatus may be configured to be worn on the hand of a user such that the length of the finger extension plate portion 103 extends from a backhand portion to a finger portion of the user's hand along the length of the index finger.

Further, in various embodiments, an exemplary hand strap apparatus 10 may comprise an adjustable strap mechanism 130 configured to engage at least a portion of the hand 1 of a user to facilitate an attachment of the hand strap apparatus 10 (e.g., the backhand strap plate 100) relative to the user's hand 1 such that the hand strap apparatus may be worn by the user. For example, an adjustable strap mechanism 130 may comprise a band, a strap, and/or the like that defines a selectively adjustable length between two ends thereof, at least one of the ends being removably attached the backhand strap panel 100 of the hand strap apparatus 10 to facilitate selective tightening of the hand strap apparatus 10 to the hand 1 and/or arm of a user. In various embodiments, the adjustable strap mechanism 130 may be defined by any structure designed to connect to a backhand strap plate 100 and pass under at least a portion of the user's hand 1 such as, for example, a wrist portion 1*c*, so as to define an enclosed opening within which the at least a portion of a user's hand 1 (e.g., the wrist portion 1*c*) may be positioned during the wearing of the hand strap apparatus 10. For example, in various embodiments, for example, the adjustable strap mechanism 130 may comprise a sleeve, strap, belt, band, fastener, and/or any other portion(s) of material(s) capable of securing the backhand strap plate 100 relative to the backhand portion 1*a* of a user's hand 1. In some embodiments, the adjustable strap mechanism 130 may comprise a material intended to comfortably contact a user's hand 1, for example, a sleeve, a fabric, a breathable material, or similar fabric or material. In some embodiments, the adjustable strap mechanism 130 may include padding or other material adjacent to the user's hand 1 to provide comfortable contact with the user's hand.

As described in further detail herein, the adjustable strap mechanism 130 may be configured for engagement with one or more strap mechanism connectors provided at the backhand strap plate 100 to secure the adjustable strap mechanism 130 relative to the backhand strap plate 100. In various embodiments, the one or more strap mechanism connectors may comprise a fastener, such as, for example, a rivet component, a button, a hook, a loop component, a pin, a latch, a hook, and/or any other suitable mechanical fastening means configured for coupling a portion of the adjustable strap mechanism 130 thereto. For example, as illustrated in the top view of exemplary hand strap apparatus 10 shown in FIG. 3, in various embodiments, an exemplary backhand strap plate 100 may comprise a first strap mechanism connector 101 and a second strap mechanism connector 102 secured relative to the top surface of the backhand strap plate 100 at opposing first and second lateral sides 100*a*, 100*b* of the backhand strap plate 100, respectively. As illustrated, the hand strap apparatus 10 may be configured such that upon the adjustable strap mechanism 130 being secured relative to both the first strap mechanism connector 101 and a second strap mechanism connector 102 positioned on the opposing first and second lateral sides 100*a*, 100*b* of the backhand strap plate, the adjustable strap mechanism 130 may define an enclosed opening within which at least a portion of a user's hand 1, such as, for example, a wrist portion 1*c*, may be positioned during the wearing of the hand strap apparatus 10 such that at least a portion of the adjustable strap mechanism 130 may pass under the at least a portion of the user's hand 1. Further, in various embodiments, as illustrated, the first and second strap mechanism connectors 101, 102 may each be provided towards the rear side 100*d* of the backhand strap plate 100. In such an exemplary configuration, the hand strap apparatus 10 may be configured such that the at least a portion of the user's hand 1 under which the adjustable strap mechanism 130 may be passed to secure the apparatus relative to the user's hand may be defined by a base portion of the hand, such as, for example, the wrist portion.

Further, the adjustable strap mechanism 130 may define a length that extends between a first strap end 130*a* and a second strap end 130*b*. For example, in various embodiments, an exemplary adjustable strap mechanism 130 may have a strap length defined between a first strap end 130*a* and an opposing second strap end 130*b* of at least approximately between 50 mm and 250 mm (e.g., between 90 mm and 200 mm). As illustrated, the adjustable strap mechanism 130 may be configured to connect to the one or more strap mechanism connectors (e.g., the first and/or second strap mechanism connectors 101, 102) at the first strap end 130*a*, the second strap end 130*b*, and/or at any point along the length thereof such that the adjustable length of the adjustable strap mechanism 130 may be extended therebetween. For example, a first strap mechanism connector 101 may be configured to be detachably secured to a first strap end 130*a* of the adjustable strap mechanism 130. In various embodiments, the first strap mechanism connector 101 may comprise a rivet component configured for coupling to the first strap end 130*a* of the adjustable strap mechanism 130 so as to define a pivotable engagement, wherein a central axis of the first strap mechanism connector 101 (e.g., extending in a direction at least substantially perpendicular to the top surface of the backhand strap plate 100) defines an axis of rotation about which the length of the adjustable strap mechanism 130 may rotate. For example, such an exemplary rivet component may be configured to detachably secure the adjustable strap mechanism 130 relative to the backhand strap plate 100 while allowing at least a portion of the adjustable strap mechanism 130 to rotate relative to backhand strap plate 100, such as, for example, based on one or more hand movements of a user's hand in order to accommodate a flexible fit relative to the hand of the user during operation of the hand strap apparatus 10.

Further, in various embodiments, the second strap mechanism connector 102 may comprise a looped fastener through which a second strap end 130*b* of the adjustable strap mechanism 130 may be passed and folded thereover such that the portion of the strap length that has been threaded through the looped fastener may be redirected back towards the portion of the strap length defined between the second strap mechanism connector 102 and the first strap mechanism connector 101 for detachable engagement therewith. In such an exemplary circumstance, as illustrated, an adjustable strap mechanism 130 may comprise a first portion 131 and a second portion 132 defined by respective portions of the strap length of the adjustable strap mechanism 130, such that, upon the second strap end 130*b* being strung through the second strap mechanism connector 102, a selective portion of the second portion 132 may be selectively coupled relative to the first portion 131 to secure the adjustable strap mechanism 130 relative to the second strap mechanism connector 102. For example, such an exemplary configuration may define the adjustability of the adjustable strap mechanism 130, wherein the length of the second portion 132 engaged with the first portion 131 may correspond to the size of the user's hand 1 (e.g., the wrist portion thereof) to which the strap mechanism 130 is being secured. In various embodiments, the adjustable strap mechanism 130 may be adjusted to accommodate the size of a user's hand by changing the amount of the strap length of the adjustable strap mechanism 130 that is threaded through the looped fastener 102 prior to said length being folded over the looped fastener, as described above.

Figure 4B:
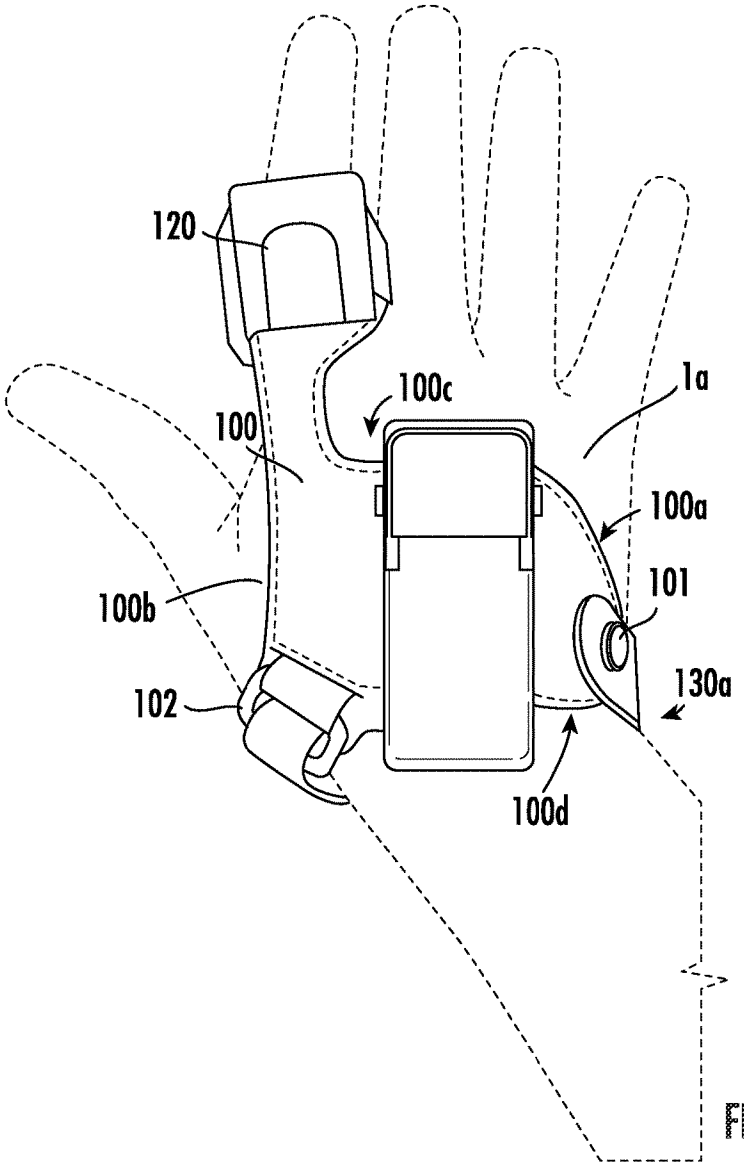
FIGS. 4A-4C illustrate various views of an exemplary hand strap apparatus being worn by a user in accordance with one or more example embodiments described herein.
Figure 4A:
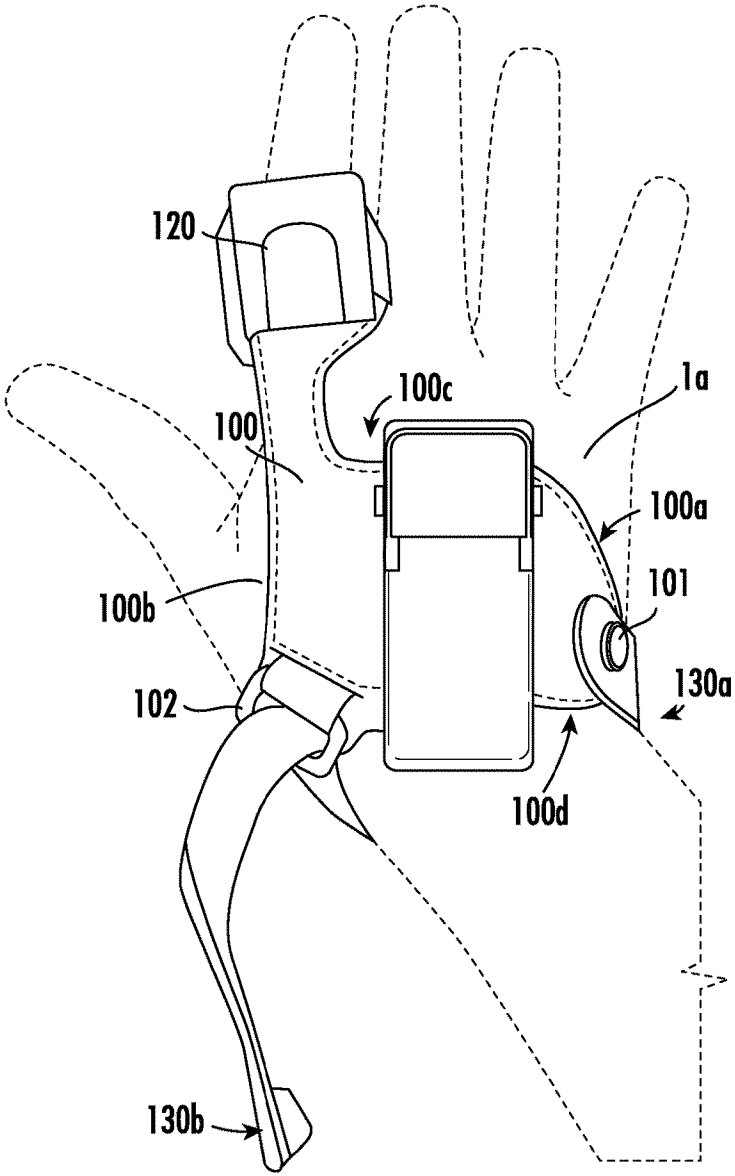
Figure 4C:
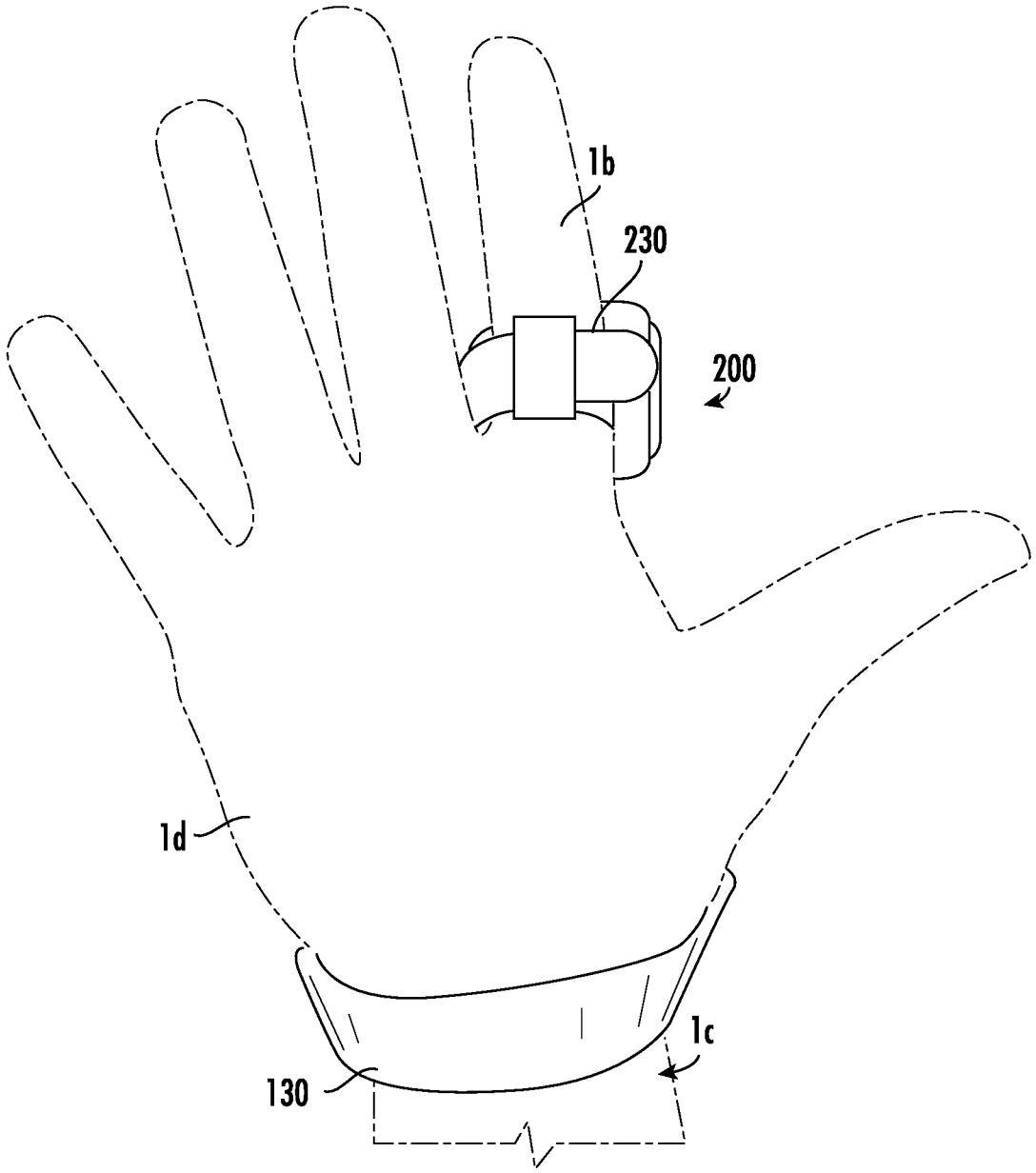

For example, FIGS. 4A-4C illustrate various views of an exemplary hand strap apparatus being worn by a user in accordance with one or more example embodiments described herein. In particular, FIGS. 4A-4C illustrate an exemplary hand strap apparatus 10 comprising a backhand strap plate 100 wherein the adjustable strap mechanism 130 is secured relative to the first and second strap mechanism connectors 101, 102 so as to secure the backhand strap plate 100 relative to a backhand portion 1*a* of the user's hand 1. As illustrated, the adjustable strap mechanism 130 may be configured to engage the user's hand 1 so as to secure the backhand strap plate 100 (e.g., and a mobile device coupled therewith) in an operable position relative to the backhand portion 1*a* of the user's hand 1. The first strap end 130*a* is pivotably engaged with the first strap mechanism connector 101 comprising a rivet component. As illustrated, the second strap end 130*b* is passed under a wrist portion 1*c* of the user's hand 1 to the second strap mechanism connector 102 comprising a looped fastener. As illustrated in FIGS. 4A-4B, upon the second strap end 130*b* of the adjustable strap mechanism 130 having been threaded through the looped fastener defining the second strap mechanism connector 102 and folded thereover, the portion of the strap length that has been threaded through the looped fastener may be redirected back towards the portion of the strap length provided below the wrist portion 1*c* of the user's hand 1 between the second strap mechanism connector 102 and the first strap mechanism connector 101 and secured relative thereto (e.g., via corresponding surfaces defined by an adhesive, Velcro, and/or the like).

As illustrated in FIG. 4C, the adjustable strap mechanism 130 may be wrapped at least partially around a wrist portion 1*c* of the user's hand 1 to secure the adjustable strap mechanism 130 in an adjustable configuration relative to the first and second strap mechanism connectors 101, 102 such that the backhand strap plate 100 and/or a mobile device attached relative to a top surface of the backhand strap plate 100 (e.g., mobile device 30 as shown in FIGS. 4A-4B) may be secured relative to the backhand portion 1*a* of the user's hand 1. As illustrated in FIG. 4C, at least a portion of the adjustable strap mechanism 130 may extend between the first and second strap mechanism connectors 101, 102 and wrap at least partly around a wrist portion 1*c* of the user's hand 1 to cause a bottom surface of the backhand strap plate 100 to be held against a surface of the backhand portion 1*a* of the user's hand 1.

Figure 3:
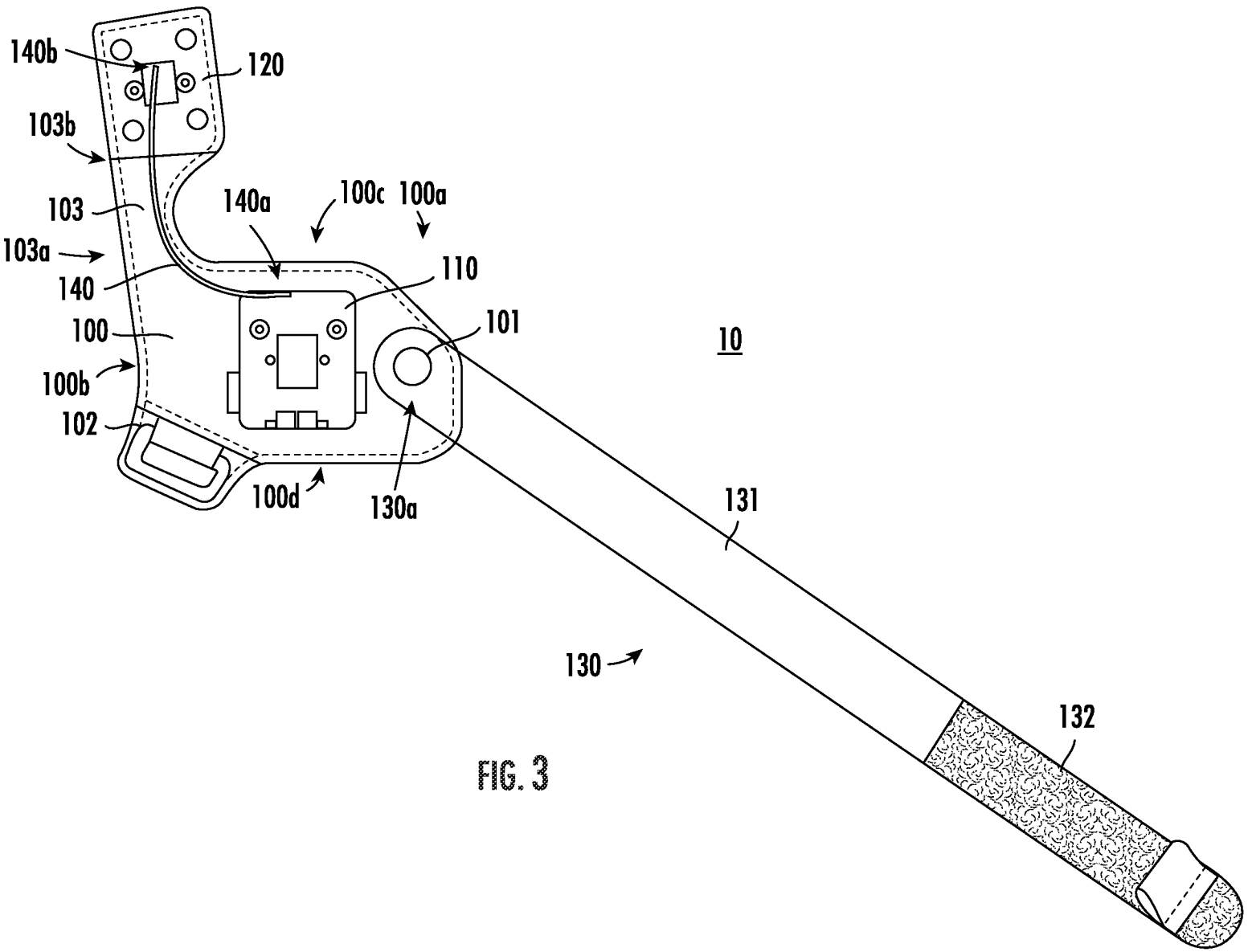
FIG. 3 illustrates a top view of an exemplary hand strap apparatus in accordance with one or more example embodiments described herein.

With reference again to the exemplary hand strap apparatus 10 illustrated in FIG. 3, in various embodiments, the hand strap apparatus 10 may comprise a backhand mount component 110 and a finger mount component 120 configured for securing a mobile device (not shown) relative to the hand of a user and facilitating operation thereof using a trigger button defined by a ring mount attachment (not shown) that the hand strap apparatus 10 is configured to detachably receive at a ring mount attachment docking interface of the finger mount component 120. As illustrated and described herein, the backhand mount component 110 of the hand strap apparatus 10 may be fixedly secured to the backhand strap plate 100 at a top surface thereof such that the backhand mount component 110 may be easily accessible for selective mounting (e.g., in a mounted position) and/or detachment of a mobile device at the backhand mount component 110. An exemplary backhand mount component 110 may comprise a mobile device interface defined by one or more mounting features configured to engage a corresponding mounting interface of the mobile device in order to secure the mobile device in a mounted position atop of the backhand mount component 110.

Figure 5:
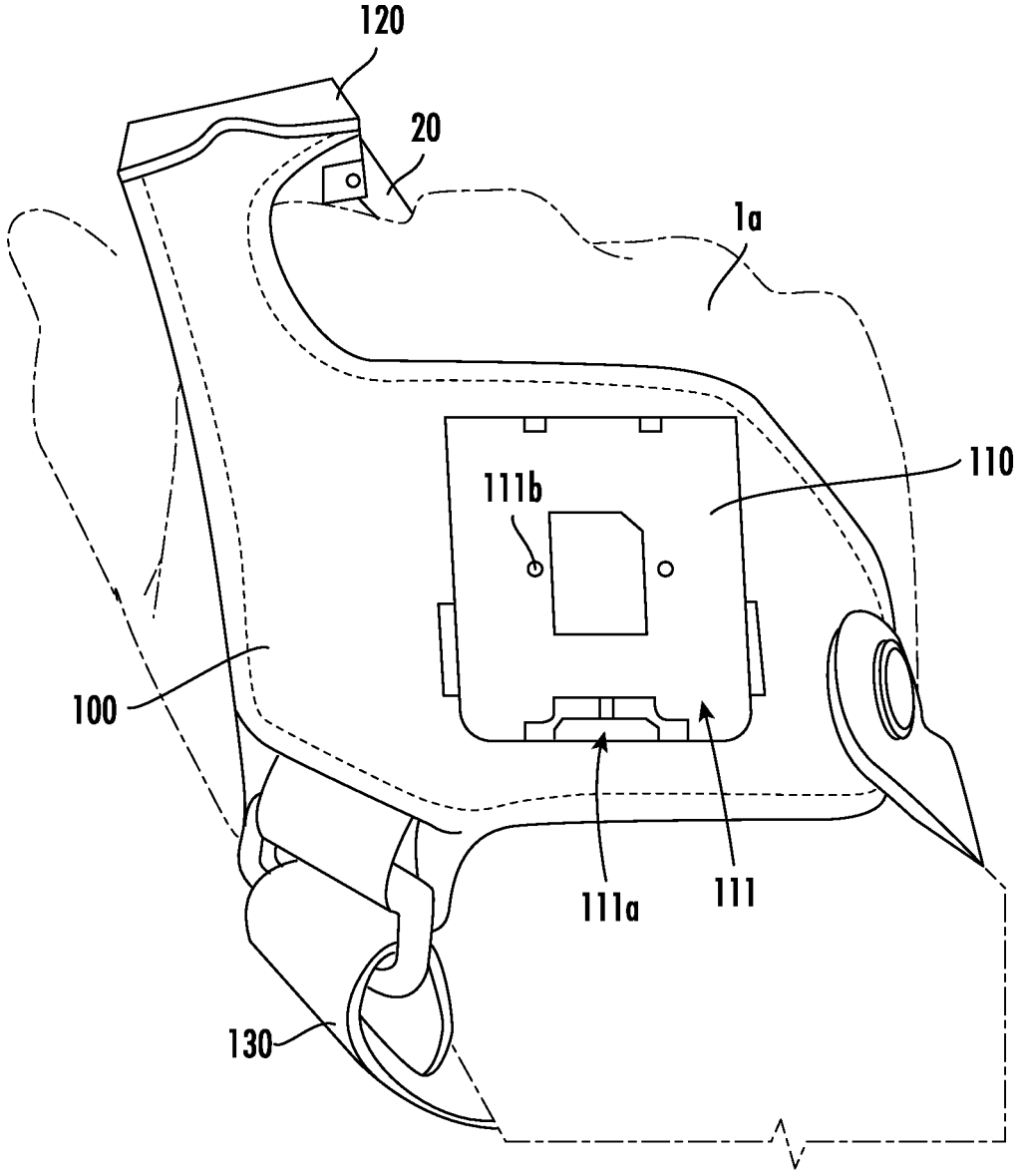
FIG. 5 illustrates a perspective view of an exemplary hand strap apparatus being worn by a user in accordance with one or more example embodiments described herein.

For example, FIG. 5 illustrates an exemplary hand strap apparatus 10 being worn on the hand 1 of a user in accordance with one or more example embodiments described herein. As illustrated, the exemplary hand strap apparatus 10 comprises an exemplary backhand mount component 110 positioned on a top surface of the backhand strap plate 100 and comprising a mobile device interface 111 configured for engagement with the mounting interface of a mobile device (not shown) such that the mobile device may be detachably secured in a mounted position atop the backhand strap plate 100. As illustrated, the mobile device interface 111 of an exemplary backhand mount component 110 may define one or more mounting features 111*a* configured to physically engage a mounting interface of a mobile device to facilitate the detachable mounting of the mobile device relative to the backhand strap plate 100 in the mounted position atop the backhand mount component 110. In various embodiments, the one or more mounting features 111*a* may define a clip, a latch, a hook, and/or the like, or any other fastening means capable engaging the mounting interface of a mobile device to secure the mobile device to the backhand mount component 110 in a mounted position. For example, in various embodiments, the one or more mounting features 111*a* of the mobile device interface 111 may have a configuration that corresponds to and/or is complementary of the configuration of the mounting interface of the mobile device such that the mounting of the mobile device in a mounted position may be defined by a robust coupling of the mobile device to the hand strap apparatus 10.

Further, as illustrated, in various embodiments, the mobile device interface 111 of a backhand mount component 110 may define one or more electronic connection elements 111*b* configured to engage the mounting interface of the mobile device at a corresponding electronic (e.g., at least partially conductive) component, surface, and/or the like defined by the mounting interface. As described herein, the one or more electronic connection elements 111*b* of the mobile device interface 111 may be configured to engage the mounting interface of a mobile device provided in the mounted position to enable electronic communication between the mounted mobile device and one or more electronic components of the hand strap apparatus 10. Alternatively, and/or additionally, in various embodiments, the one or more electronic connection elements 111*b* of the mobile device interface 111 may be configured to engage the mounting interface of a mobile device mounted at the backhand mount component 110 to enable electronic communication between the mounted mobile device and an attachment component electronically connected to the hand strap apparatus 10, such as, for example, a ring mount attachment mounted to a finger mount component 120. For example, in various embodiments, the one or more electronic connection elements 111*b* of the mobile device interface 111 may have a configuration that corresponds to and/or is complementary of the configuration of one or more electronic connection elements defined by the mounting interface of the mobile device, such that the mobile device may be electronically communicative with the hand strap apparatus 10 upon the mounting of the mobile device in a mounted position at the backhand mount component 110.

With reference again to the exemplary embodiment illustrated in FIG. 3, an exemplary hand strap apparatus 10 may comprise internal circuitry 140 configured to be in electronic communication with the backhand mount component 110 and the finger mount component 120 of the hand strap apparatus 10. In various embodiments, the internal circuitry 140 may extend between the backhand mount component 110 and the finger mount component 120 so as to establish an electronic connection between the two components. For example, as illustrated, the internal circuitry 140 may extend from a first circuitry end 140*a* connected to the backhand mount component 110 (e.g., at the one or more electronic connection element 111*b* of the mobile deice interface 111 and/or a connection defined by the mount component 110 in electronic communication therewith) to a second circuitry end 140*b* connected to the finger mount component 120. In various embodiments, the internal circuitry 140 may be provided within an interior of the backhand strap plate 100 defined between the top surface and the bottom surface thereof, such that the internal circuitry 140 is not exposed and/or accessible to a user wearing the hand strap apparatus 10. As illustrated in FIG. 3, the finger mount component 120 configured for electronic communication with the first mount component 110 via the internal circuitry 140 connected therewith may be disposed at a distal finger extension plate portion end 103*b* of the finger extension plate portion 103 of the backhand strap plate 100 such that the internal circuitry 140 connecting the backhand mount component 110 to the finger mount component 120 extends along the length of the finger extension plate portion 103. In various embodiments, as described in further detail herein, a finger mount component 120 disposed along distal finger extension plate portion end 103*b* of the finger extension plate portion 103 of the backhand strap plate 100 may be configured for selectively receiving a ring mount attachment such that the ring mount attachment is detachably secured in an attached position relative to the finger mount component 120 of the hand strap apparatus 10. As described herein, an exemplary hand strap apparatus 10 may be configured such that a ring mount attachment (not shown) provided in an attached position at the finger mount component 120 may be at least partially secured relative to the hand of a user (e.g., a finger portion).

Figure 6:
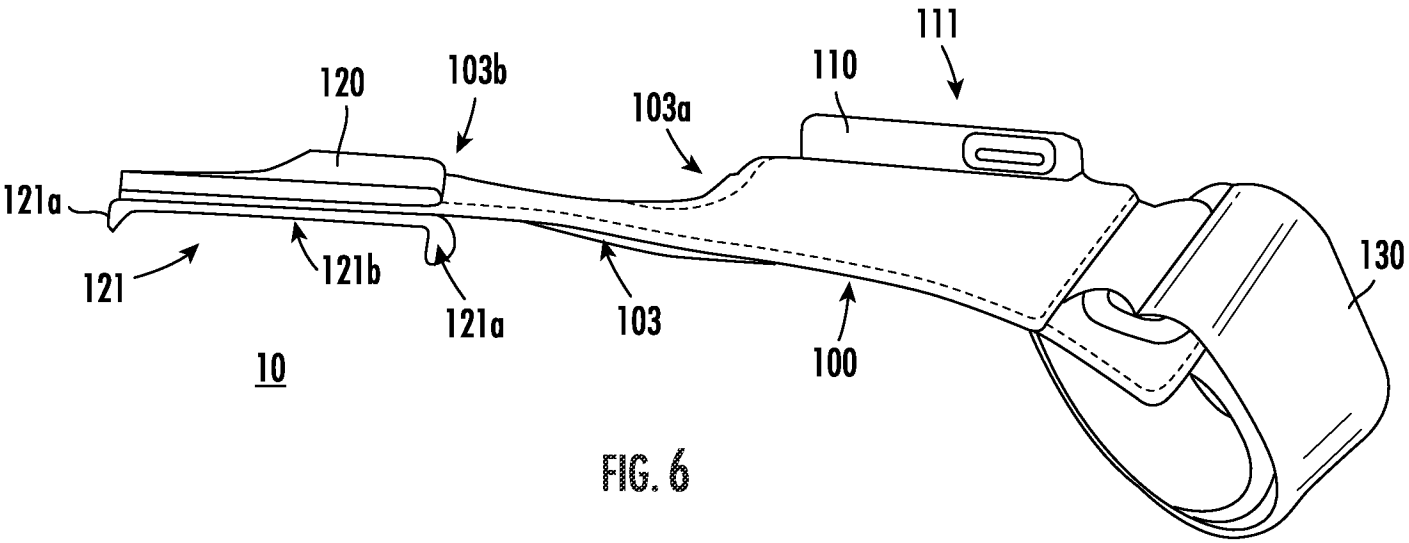
FIG. 6 illustrates a side view of an exemplary hand strap apparatus in accordance with one or more example embodiments described herein.

In various embodiments, an exemplary finger mount component 120 may comprise a ring mount attachment interface defined by one or more mounting features configured to engage a corresponding mobile device interface of a ring mount attachment in order to secure the ring mount attachment in an attached position relative to a bottom surface of the finger mount component 120. For example, FIG. 6 illustrates a side perspective view of an exemplary hand strap apparatus 10 comprising a backhand mount component 110 and a finger mount component 120 in accordance with one or more example embodiments described herein. As illustrated, the hand strap apparatus 10 comprises an exemplary finger mount component 120 defined at a distal finger extension plate portion end 103*b* of the finger extension plate portion 103 of the backhand strap plate 100 and comprising a ring mount attachment interface 121 configured for engagement with a mobile device interface of a ring mount attachment (not shown) such that the ring mount attachment may be detachably secured in an attached position relative to a bottom surface of the finger mount component 120. As illustrated, the ring mount attachment interface 121 of an exemplary finger mount component 120 may define one or more mounting features 121*a* configured to physically engage a mobile device interface of a ring mount attachment, as described herein, to facilitate the selective attachment of the ring mount attachment relative to the backhand strap plate 100 of the hand strap apparatus 10. In various embodiments, the one or more mounting features 121*a* may define a clip, a latch, a hook, and/or the like, or any other fastening means capable engaging the mobile device interface of a ring mount attachment to secure the ring mount attachment to the finger mount component 120 in an attached position. For example, in various embodiments, the one or more mounting features 121*a* of the ring mount attachment interface 121 may have a configuration that corresponds to and/or is complementary of the configuration of the mobile device interface of the ring mount attachment such that the attachment of the ring mount attachment in an attached position at the finger mount component 120 may be defined by a robust coupling of the ring mount attachment to the hand strap apparatus 10.

Further, as illustrated, in various embodiments, the ring mount attachment interface 121 of a finger mount component 120 may define one or more electronic connection elements 121*b* configured to engage the mobile device interface of the ring mount attachment at a corresponding electronic component, surface, and/or the like defined by the mobile device interface. As described herein, the one or more electronic connection elements 121*b* of the ring mount attachment interface 121 may be configured to engage the mobile device interface of a ring mount attachment secured in the attached position at the finger mount component 120 to enable electronic communication between the attached ring mount attachment and a mobile device mounted to the backhand strap plate 100 in a mounted position at a backhand mount component (e.g., at the mobile device interface 111) of the hand strap apparatus 10. For example, in various embodiments, the one or more electronic connection elements 121*b* of the ring mount attachment interface 121 may have a configuration that corresponds to and/or is complementary of the configuration of one or more electronic connection elements defined by the mobile device interface of the ring mount attachment, such that the ring mount attachment may be electronically communicative with the hand strap apparatus 10 upon the attachment of the ring mount attachment in an attached position to the ring mount attachment interface 121 defined by the finger mount component 120.

Figure 7:
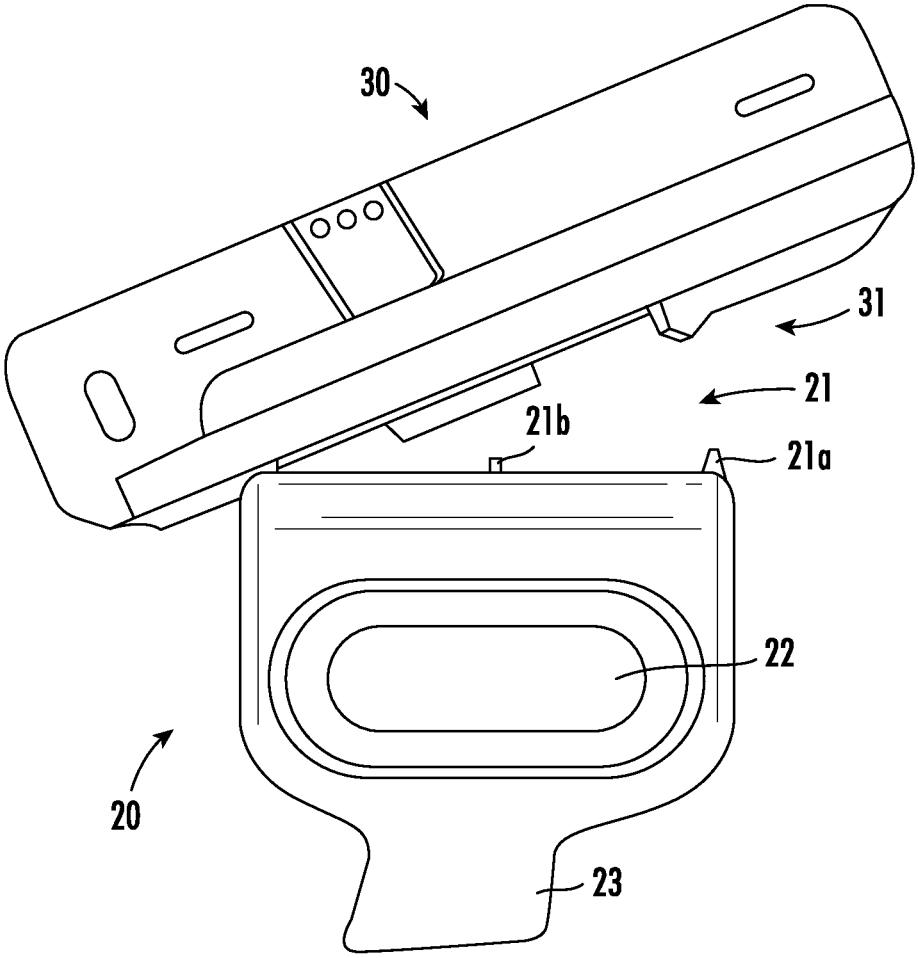
FIG. 7 illustrates a side view of a ring scanner attachment and a mobile device in accordance with one or more example embodiments described herein.

As described herein, an exemplary ring mount attachment may embody a wearable strap apparatus configured for mounting a mobile device relative thereto and for being worn around one or more fingers of a user (e.g., around the index finger in the style of a ring) so as to secure the mobile device relative to the one or more fingers of the user. FIG. 7 illustrates a side view of an exemplary ring mount attachment according to various example embodiments described herein. In particular, FIG. 7 illustrates a ring mount attachment 20 configured for attaching a mobile device 30 to one or more of a user's fingers, such as, for example, a user's index finger, in order to facilitate use of the mobile device while the mobile device remains secured relative to the user's one or more fingers. It will be appreciated that the illustrated ring mount attachment 20 is provided as an example embodiment and should not be construed to narrow the scope or spirit of the disclosure in any way. In various embodiments, as illustrated, a ring mount attachment 20 may comprise a mobile device interface 21, a trigger button 22, and/or a finger strap 23.

In various embodiments, a ring mount attachment 20 may comprise a finger strap 23 configured to engage one or more fingers of a user to facilitate an attachment of the ring mount attachment 20 relative to the user's fingers such that the ring mount attachment 20 may be worn by the user. For example, a finger strap 23 may comprise a band, a strap, and/or the like configured to be selectively secured relative to at least a portion of one or more of a user's fingers (e.g., an index finger) In various embodiments, the finger strap 23 may be defined by any structure and/or material component designed to be removably secured to the finger(s) of a user, such as, for example, by passing at least a portion of a length thereof under the one or more of the user's fingers on which the ring mount attachment 20 is to be worn so as to define an enclosed opening within which the one or more fingers may be positioned during the wearing of the ring mount attachment 20.

As further, illustrated, the ring mount attachment 20 may comprise a mobile device interface 21 defined at a top surface of the ring mount attachment 20 and configured for engagement with the mounting interface 31 of a mobile device 31 such that the mobile device 30 may be detachably secured in a mounted position atop the ring mount attachment 20. As illustrated, the mobile device interface 21 of an exemplary ring mount attachment may define one or more mounting features 21*a* configured to physically engage a mounting interface 31 of a mobile device 30 to facilitate the detachable mounting of the mobile device 30 relative thereto in a mounted position on top of the mobile device interface 21. In various embodiments, the one or more mounting features 21*a* may define a clip, a latch, a hook, and/or the like, or any other fastening means capable engaging at least a portion of the mounting interface 31 of a mobile device to secure the mobile device 30 relative to the ring mount attachment 20. For example, in various embodiments, the one or more mounting features 21*a* of the mobile device interface 21 of the ring mount attachment 20 may have a configuration that corresponds to and/or is complementary of the configuration of the mounting interface 31 of the mobile device 30 such that the mounting of the mobile device 30 in a mounted position may be defined by a robust coupling of the mobile device 30 to the ring mount attachment 20. Further, as illustrated, in various embodiments, the mobile device interface 21 of a ring mount attachment 20 may define one or more electronic connection elements 21*b* configured to engage the mounting interface 31 of the mobile device 30 at a corresponding electronic component, surface, and/or the like defined by the mounting interface 31. For example, in various embodiments, the one or more electronic connection elements 21*b* of the mobile device interface 21 of the ring mount attachment 20 may have a configuration that corresponds to and/or is complementary of the configuration of one or more electronic connection elements defined by the mounting interface 31 of the mobile device 30, such that the mobile device 30 may be electronically communicative with the ring mount attachment 20 (e.g., a trigger button 22) upon the mounting of the mobile device 30 in a mounted position.

In various embodiments, the mobile device interface 21 of the ring mount attachment 20 may be defined by a configuration that corresponds at least in part to the configuration of the mobile device interface defined by the backhand mount component 110 of the hand strap apparatus 10. For example, the mobile device interface 21 of the ring mount attachment 20 may be defined by a configuration that is at least substantially similar to the configuration of the mobile device interface defined by the backhand mount component 110, as described herein in reference to FIG. 5. For example, the exemplary mobile device 30 may be operably and independently secured to either the ring mount attachment 20 (e.g., at the mobile device interface 21) or the hand strap apparatus 10 (e.g., at the mobile device interface defined by the backhand mount component 110) in order to interchangeably reconfigure the mobile device between different wearable mounting configurations to accommodate user preferences and/or occupational requirements associated with a particular environment and/or a particular task. In such an exemplary configuration, an exemplary hand strap apparatus 10 may be configured such that the different wearable mounting configurations in which the mobile device 30 may be independently operable, as defined by the exemplary hand strap apparatus 10 and the ring mount attachment 20, may each utilize the same trigger button 22 of the ring mount attachment 20 to initiate activation of the mobile device 30.

In various embodiments, the one or more electronic connection elements 21*b* of the mobile device interface 21 of the ring mount attachment 20 may be configured to engage the mounting interface 31 of the mobile device 30 provided in the mounted position to enable electronic communication between the trigger button 22 and the mounted mobile device 30. For example, an exemplary ring mount attachment 20 may be configured such that a trigger button 22 may be engaged by a user (e.g., a user wearing the ring mount attachment 20) so as to cause one or more control signals to be generated corresponding to an operation of the ring attachment mount and/or a mobile device (e.g., mobile device 30) mounted thereto. For example, the trigger button 22 may be positioned along a lateral side of the ring mount attachment 20 and may be configured to be actuated based via one or more user interactions therewith, such as, for example, one or more pushing, sliding, touching, twisting, and/or reconfiguration action, and/or any other user engagement therewith suitable to facilitate a selective actuation of the trigger button 22 such that an electronic control signal may be generated in response. In various embodiments, the trigger button 22 may be in electronic communication with the one or more electronic connection elements 21*b* to facilitate communication of the generated control signal therethrough. For example, the ring mount attachment 20 may be configured such that the trigger button 22 a control signal generated upon a user engagement with the trigger button 22 may cause a mobile device 30 secured relative to the ring mount attachment 20 (e.g., at the mobile device interface 21) in a mounted position to execute one or more operations corresponding to the generated control signal. In such an exemplary circumstance, the ring mount attachment 20 may be configured such that, upon the mounting of the mobile device 30 in a mounted position at the mobile device interface 21 of the ring mount attachment 20, the ring mount attachment 20 may be configured to facilitate control and/or operation of the mobile device 30 independent of an exemplary hand strap apparatus, as described herein.

Figure 8:
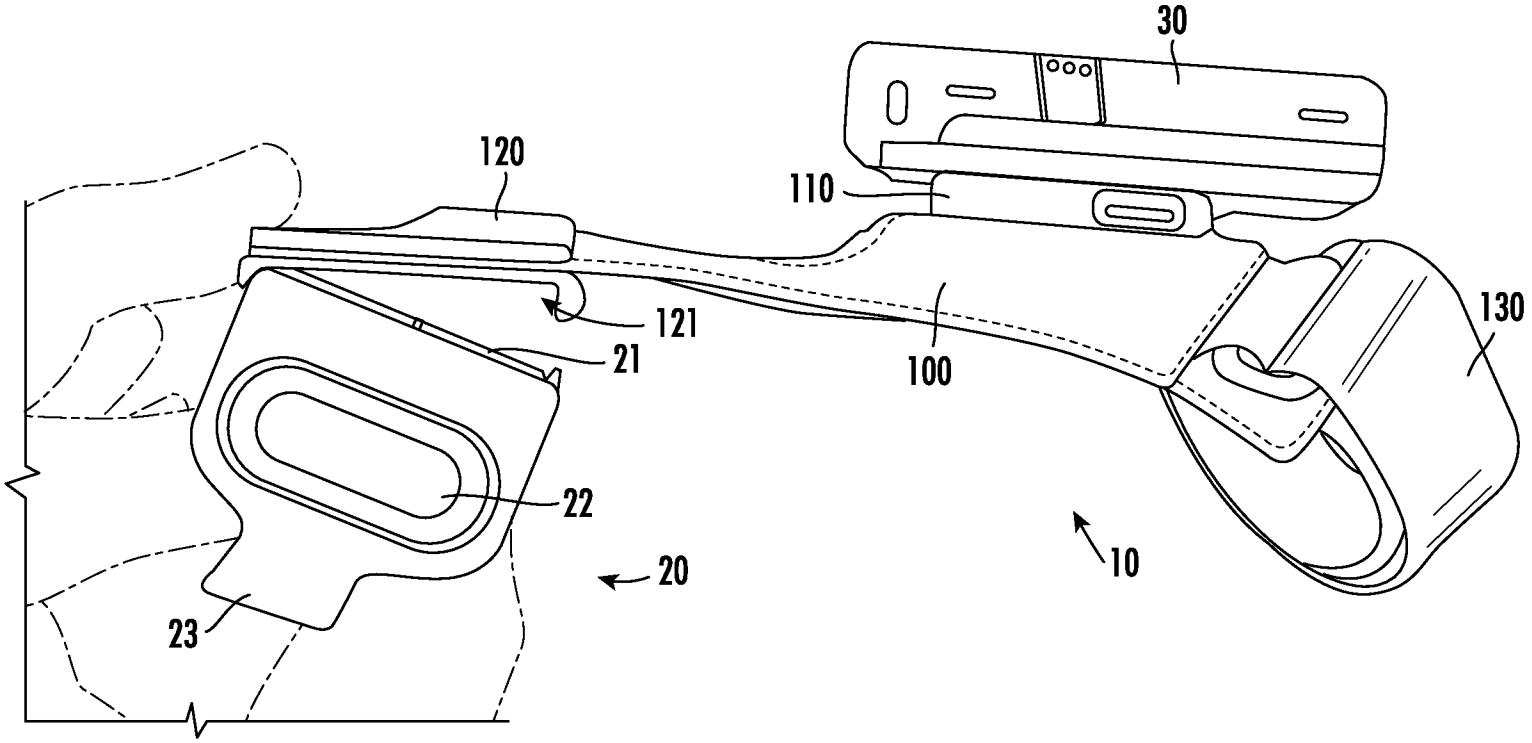
FIG. 8 illustrates a side view of an exemplary hand strap apparatus, a ring scanner attachment, and a mobile device in accordance with one or more example embodiments described herein.

Further, in various embodiments, as described herein, the mobile device interface 21 of an exemplary ring mount attachment 20 may be configured to engage the ring mount attachment interface 121 of the finger mount component 120 of an exemplary hand strap apparatus 10 to secure the ring mount attachment 20 in an attached position relative to the hand strap apparatus 10 and enable electronic communication between the ring mount attachment 20 (e.g., the trigger button 22) and a mobile device 30 secured in a mounted position at the backhand mount component 110 of the hand strap apparatus 10, as illustrated in the exemplary embodiment shown in FIG. 8. FIG. 8 illustrates a side view of an exemplary hand strap apparatus configured according to various example embodiments described herein. In particular, FIG. 8 illustrates an exemplary hand strap apparatus 10 configured to secure both a mobile device in a mounted position at a backhand mount component 110 provided on a top surface of a backhand strap plate 100, and a ring mount attachment 20 in an attached position at the finger mount component 120. In various embodiments, as described herein, the finger mount component 120 may be configured to receive a ring mount attachment 20, such as, for example, the exemplary ring mount attachment embodiment described above with respect to FIG. 7. For example, an exemplary hand strap apparatus 10 may be configured to receive a ring mount attachment that does not have a mobile device 30 secured relative thereto in a mounted position (e.g., at the mobile device interface 21) at the ring mount attachment interface 121 defined by the finger mount component 120. In such an exemplary circumstance, the ring mount attachment 20 may be secured in an attached position relative to the finger mount component 120 such that the ring mount attachment interface 121 is engaged with the mobile device interface 21 of the ring mount attachment 20. In various embodiments, as described herein, the one or more mounting features 121*a* and the one or more electronic connection elements 121*b* of the ring mount attachment interface 121 of the finger mount component 120 may have a configuration that corresponds to and/or is complementary of the configuration of the one or more mounting features 21*a* and the one or more electronic connection elements 21*b* of the mobile device interface 21 of the ring mount attachment such that the ring mount attachment 20 may secured relative to the finger mount component 120 and may be electronically communicative with the hand strap apparatus 10 upon the attachment of the ring mount attachment 20 in an attached position at the finger mount component 120.

As illustrated in FIG. 8, in various embodiments, the ring mount attachment interface 121 of the finger mount component 120 may be defined on a bottom side of the finger mount component 120 such that a ring mount attachment 20 engaged with the hand strap apparatus 10 in an attached position at the finger mount component 120 may be disposed at least substantially below the finger mount component 120. For example, in such an exemplary configuration, a ring mount attachment 20 in an attached position relative to the hand strap apparatus 10 may be disposed at least substantially beneath the finger mount component 120 based at least in part on the downward-facing orientation of the ring mount attachment interface 121 and/or the mobile device interface 21 of the ring mount attachment 20 being defined along an upward-facing top surface of the ring mount attachment 20.

In various embodiments, to facilitate the selective attachment of a ring mount attachment 20 to an exemplary hand strap apparatus 10, the finger mount component 120 of the hand strap apparatus 10 may define a ring mount attachment interface 121 that has a configuration corresponding at least in part to the configuration of the mounting interface of an exemplary mobile device 30, as described herein. For example, in various embodiments, wherein the mobile device interface 21 of an exemplary ring mount attachment 20 may be configured to receive the mounting interface 31 of a mobile device 30 to enable operation of the mobile device 30 by the ring mount attachment 20 (e.g., via the trigger button 22) independent of the hand strap assembly 10, as described herein, and wherein the finger mount component 120 of the hand strap apparatus 10 may be configured to receive the ring mount attachment 20 in an attached position via an engagement of the ring mount attachment interface 121 to the mobile device interface 21, the ring mount attachment interface 121 may be defined by a configuration (e.g., one or more mounting features and/or electronic connection elements) that is at least substantially similar to that of the mounting interface of the mobile device 30. Further, in various embodiments, wherein the hand strap assembly 10 may be configured to receive a mobile device 30 in a mounted position at a backhand mount component 110 via an engagement of the mobile device interface 111 to the mounting interface of the mobile device 30, as illustrated, the mobile device interface 111 defined by the backhand mount component 110 may be defined by a configuration (e.g., one or more mounting features and/or electronic connection elements) that is at least substantially similar to that of the mobile device interface 21 of the ring mount attachment 20.

Figure 9:
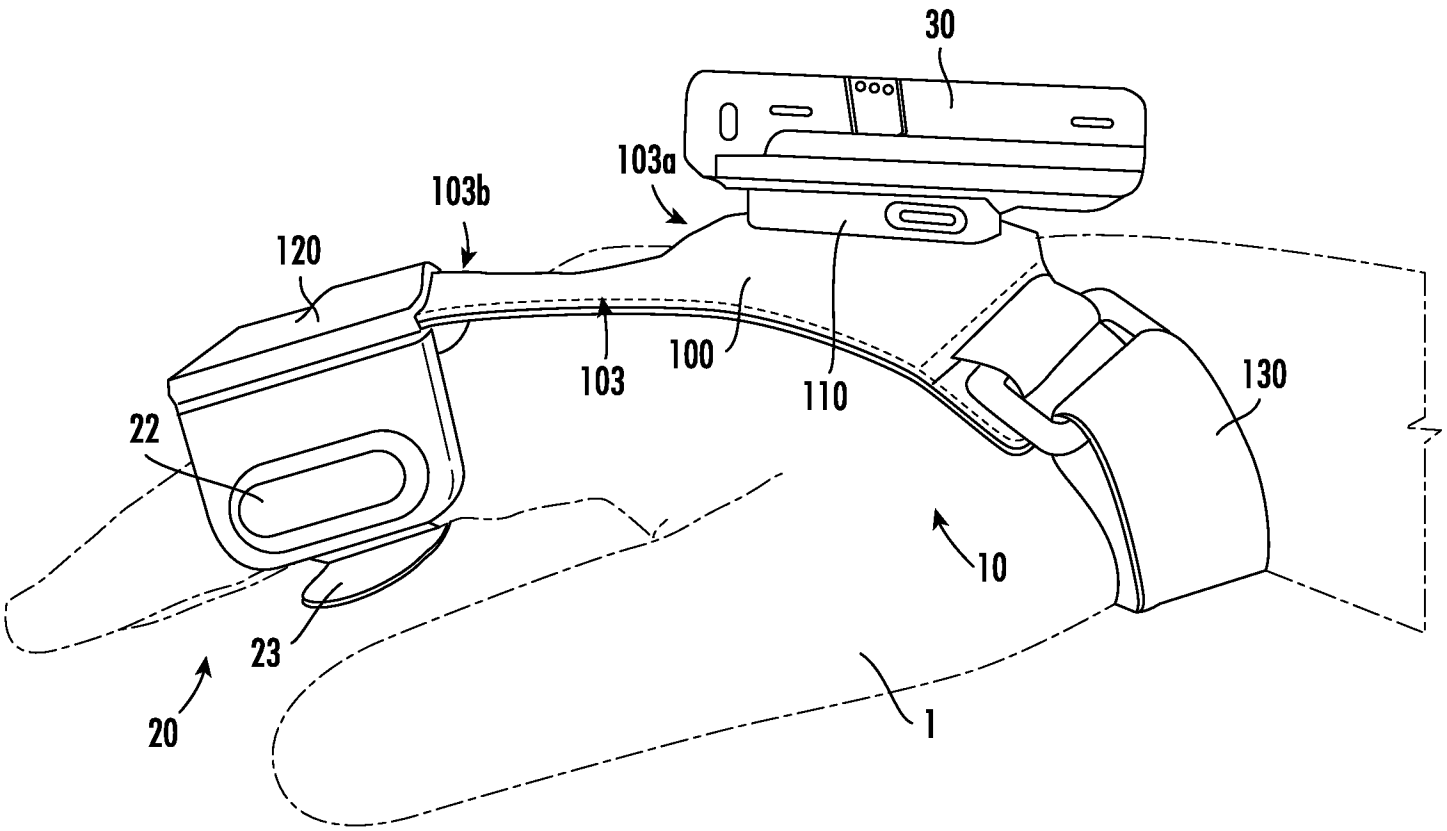
FIG. 9 illustrate a side view of an exemplary hand strap apparatus, a ring scanner attachment, and a mobile device in accordance with one or more example embodiments described herein.

FIG. 9 illustrates a side view of an exemplary hand strap apparatus, a ring scanner attachment, and a mobile device in accordance with one or more example embodiments described herein. In particular, the exemplary hand strap apparatus 10 is shown with a mobile device 30 secured in a mounted position at a backhand mount component 110, and a detachable ring mount attachment 20 secured in an attached position at a finger mount component 120. As illustrated and described herein, the finger mount component 120 of the hand strap apparatus 10 may be fixedly attached to the backhand strap plate 100 at the finger extension plate portion 103 (e.g., a distal finger extension plate portion end 103*b*) such that the ring strap 23 of the ring mount attachment 20 secured to the finger mount component 120 in an attached position may be easily accessible for selective wearing and/or removal from an index finger of the user's hand 1. Further, as shown, in an exemplary circumstance wherein the ring mount attachment 20 is secured relative to the hand strap apparatus 10 in an attached position, the hand strap apparatus 10 may be configured such that at least a portion of the finger mount component 120, such as, for example, the ring mount attachment interface 121, may be arranged above the index finger of the user's hand 1 upon the ring strap 23 being donned upon the user's index finger, as described herein. In such an exemplary configuration, the trigger button 22 defined by the ring mount attachment 20 may be easily accessible to the thumb of the user's hand 1.

In various embodiments, a hand strap apparatus 10 may be configured to operate and/or control a mobile device 30 secured in a mounted position at the backhand mount component 110 using the trigger button 22 of the ring mount attachment 20 based at least in part on the backhand mount component 110 and the finger mount component 120 being in electronic communication with one another such one or more signals may be transmitted between that the mobile device 30 and the ring mount attachment 20 detachably engaged therewith, respectively. For example, in the exemplary configuration illustrated in FIG. 9, the hand strap apparatus 10 may be configured to receive the detachable ring mount attachment 20 such that the mobile device interface of the ring mount attachment is electronically connected with the finger mount component 120 (e.g., the ring mount attachment interface) and one or more control signals generated based upon a user engagement with the trigger button 22 may be transmitted to the mobile device 30 and used to operate the mobile device 30. As described herein, the exemplary hand strap apparatus 10 is configured to operatively engage a mobile device interface of an independently operable ring mount attachment 20 such that the same trigger button 22 may be used to control the mobile device 30 when the mobile device 30 is mounted to the hand strap apparatus 10 as may be used when the mobile device 30 is mounted to the ring mount attachment 20. Such an exemplary configuration may define a wearable strap assembly having a modular design that enables a decrease in maintenance costs and operational expenses, and, further, increases the comfort experience by the user and the ease of cleaning the apparatus and/or the various components of the assembly.

In various embodiments, a wearable strap assembly may comprise the hand strap apparatus 10 and the ring mount attachment 20. Further, in various embodiments, a wearable strap assembly may comprise the hand strap apparatus 10, the ring mount attachment 20, and a mobile device. For example, in various embodiments, the exemplary wearable strap assembly may be configured such that the mobile device 30 may be operably and independently secured to either the ring mount attachment 20 (e.g., at the mobile device interface 21) or the hand strap apparatus 10 (e.g., at the mobile device interface defined by the backhand mount component 110) in order to interchangeably reconfigure the mobile device between different wearable mounting configurations to accommodate user preferences and/or occupational requirements associated with a particular environment and/or a particular task. In such an exemplary configuration, an exemplary hand strap apparatus 10 may be configured such that the different wearable mounting configurations in which the mobile device 30 may be independently operable, as defined by the exemplary hand strap apparatus 10 and the ring mount attachment 20, may each utilize the same trigger button 22 of the ring mount attachment 20 to initiate activation of the mobile device 30.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hand strap apparatus for securing a mobile device relative to a hand of a user, the hand strap comprising:

a backhand strap plate configured for positioning against a backhand portion of the hand of the user based at least in part on an engagement of a strap mechanism with the hand of the user;

a backhand mount component positioned on a top surface of the backhand strap plate, the backhand mount component being configured to receive a mobile device so as to secure the mobile device in a mounted position relative to the backhand strap plate; a detachable ring attachment mount;

a finger mount component configured to receive the detachable ring mount attachment so as to secure the ring mount attachment in an attached position relative to the hand strap apparatus;

wherein the backhand mount component is in electronic communication with the finger mount component such that, upon the ring mount attachment being provided in the attached position, an operation of the mobile device secured in the mounted position is at least partially controlled by a trigger button defined by the ring mount attachment wherein the detachable ring mount attachment configured to be received by the finger mount component of the hand strap apparatus is configured such that, upon being removed from the attached position, the ring mount attachment is configured to independently receive the mobile device at a mobile device interface to facilitate an independent operation of the mobile device that is at least partially controlled by the trigger button.

2. The hand strap apparatus of claim 1, wherein the backhand strap plate includes a finger extension plate portion defined by a material extension extending from a proximal finger extension plate portion end to a distal finger extension plate portion end, the proximal finger extension plate portion end being defined at a first portion of the backhand strap plate configured for positioning against the backhand portion of the hand and the distal finger extension plate portion end being defined at a second portion of the backhand strap plate configured for positioning against a finger portion of the hand.

3. The hand strap apparatus of claim 2, wherein the finger mount component is positioned at least substantially adjacent the distal finger extension plate portion end.

4. The hand strap apparatus of claim 1, wherein the backhand mount component defines a first mobile device interface configured to engage a mounting interface defined by the mobile device so as to secure the mobile device in the mounted position relative to the backhand strap plate, and wherein the first mobile device interface defined by the backhand mount component is defined by a first configuration that is at least substantially similar to a second mobile device interface defined by the ring mount attachment.

5. The hand strap apparatus of claim 4, wherein the finger mount component is configured to receive the detachable ring mount attachment at a ring mount attachment interface defined by the finger mount component, wherein the ring mount attachment interface is configured to engage the second mobile device interface defined by the ring mount attachment.

6. The hand strap apparatus of claim 1, wherein the finger mount component defines a ring mount attachment interface configured to engage a mobile device interface defined by the ring mount attachment so as to secure the ring mount attachment in the attached position, and wherein the ring mount attachment interface is defined by a first configuration that is at least substantially similar to a mounting interface defined by the mobile device.

7. The hand strap apparatus of claim 6, wherein the backhand mount component is configured to secure the mobile device in the mounted position based at least in part on an engagement of a mobile device interface defined by the backhand mount component with the mounting interface.

8. The hand strap apparatus of claim 1, wherein the attached position is defined by the ring mount attachment received by the finger mount component being engaged with a ring mount attachment interface defined by the finger mount component, the ring mount attachment interface comprising one or more electronic connection elements configured to engage the ring mount attachment so as to establish an electronic connection between the trigger button of the ring mount attachment and the finger mount component.

9. The hand strap apparatus of claim 8, wherein the ring mount attachment interface of the finger mount component is defined on a bottom side of the finger mount component such that the ring mount attachment being secured relative thereto in the attached position comprises the ring mount attachment being disposed at least substantially below the finger mount component.

10. The hand strap apparatus of claim 1, wherein the hand strap apparatus is configured such that, upon the ring mount attachment being secured relative thereto in the attached position, a ring strap of the ring mount attachment is configured for engagement with an index finger of the hand of the user.

11. The hand strap apparatus of claim 1, further comprising a first strap mechanism connector and a second strap mechanism connector secured relative to the top surface of the backhand strap plate, the strap mechanism being configured to engage both the first strap mechanism connector and the second strap mechanism connector so as to define an at least partially adjustable configuration.

12. The hand strap apparatus of claim 11, wherein the first strap mechanism connector is disposed at least substantially adjacent a first lateral side of the backhand strap plate, wherein the second strap mechanism connector is disposed at least substantially adjacent a second lateral side of the backhand strap plate, the second lateral side embodying an opposite lateral side of the backhand strap plate relative to the first lateral side, and wherein the strap mechanism defines an adjustable length configured to extend between the first and second strap mechanism connectors by passing underneath a wrist portion of the hand of the user.

13. The hand strap apparatus of claim 11, wherein the first strap mechanism connector comprises a rivet component configured for coupling to a first strap end of the strap mechanism so as to define a pivotable engagement between the first strap end and the backhand strap plate, wherein the pivotable engagement defines a range of relative rotational motion between the backhand strap plate and the first strap end of the strap mechanism detachably fastened to the rivet component.

14. The hand strap apparatus of claim 11, wherein the second strap mechanism connector comprises a looped fastener defining an opening configured for receiving at least a second strap end of the strap mechanism therethrough to facilitate an adjustable configuration of the strap mechanism.

15. The hand strap apparatus of claim 1, further comprising internal circuitry extending from a first circuitry end electronically connected to the backhand mount component to a second circuitry end electronically connected to the finger mount component to facilitate the electronic communication between the backhand mount component and the finger mount component.

16. The hand strap apparatus of claim 15, wherein the internal circuitry is configured to transmit one or more control signals received by the hand strap apparatus to the mobile device provided in the mounted position, the one or more control signals being generated by a user engagement with the trigger button of the ring mount attachment.

17. The hand strap apparatus of claim 16, wherein the internal circuitry is provided within an interior portion of the backhand strap plate, the interior portion being defined between the top surface and a bottom surface thereof.

18. The hand strap apparatus of claim 1, wherein the mounted position is defined by the mobile device received by the backhand mount component being engaged with a mobile device interface defined by the backhand mount component, the mobile device interface comprising one or more electronic connection elements configured to engage the mobile device so as to establish an electronic connection between the mobile device and the hand strap apparatus.

19. A hand strap apparatus for securing a mobile device relative to a hand of a user, the hand strap comprising: a backhand strap plate configured for positioning against a backhand portion of the hand of the user based at least in part on an engagement of a strap mechanism with the hand of the user; a backhand mount component positioned on a top surface of the backhand strap plate, the backhand mount component being configured to receive a mobile device so as to secure the mobile device in a mounted position relative to the backhand strap plate; a finger mount component configured to receive a detachable ring mount attachment so as to secure the ring mount attachment in an attached position relative to the hand strap apparatus; wherein the backhand mount component is in electronic communication with the finger mount component such that, upon the ring mount attachment being provided in the attached position, an operation of the mobile device secured in the mounted position is at least partially controlled by a trigger button defined by the ring mount attachment; wherein the attached position is defined by the ring mount attachment received by the finger mount component being engaged with a ring mount attachment interface defined by the finger mount component, the ring mount attachment interface comprising one or more electronic connection elements configured to engage the ring mount attachment so as to establish an electronic connection between the trigger button of the ring mount attachment and the finger mount component; wherein the one or more electronic connection elements are configured to engage a second one or more electronic connection elements provided at a mobile device interface defined by the ring mount attachment, wherein the second one or more electronic connection elements are further configured for engagement with a third one or more electronic connection elements provided at a mounting interface defined by the mobile device such that the ring mount attachment provided in a detached configuration relative to the hand strap apparatus is configured for securing the mobile device relative to the ring mount attachment in a second mounted position defined at the mobile device interface.

* * * * *